US007255776B2

(12) United States Patent
Shoshany et al.

(10) Patent No.: US 7,255,776 B2
(45) Date of Patent: Aug. 14, 2007

(54) PAPER PRODUCT AND METHOD THEREFOR USING MOLTEN WAX SUSPENSION

(75) Inventors: Haggai Shoshany, Kfar Tavor (IL); Amnon Shoshany, Tel Aviv (IL)

(73) Assignee: H A Industrial Technologies Ltd, Tel Aviv (IL)

( * ) Notice: Subject to any disclaimer, the term of this patent is extended or adjusted under 35 U.S.C. 154(b) by 0 days.

(21) Appl. No.: 11/153,494

(22) Filed: Jun. 16, 2005

(65) Prior Publication Data

US 2005/0230074 A1 Oct. 20, 2005

Related U.S. Application Data

(63) Continuation-in-part of application No. 10/453,591, filed on Jun. 4, 2003, now abandoned.

(51) Int. Cl.
*D21H 17/60* (2006.01)

(52) U.S. Cl. ..... 162/172; 162/158; 162/183; 106/271

(58) Field of Classification Search ..... 162/172, 162/158, 183; 106/271
See application file for complete search history.

(56) References Cited

U.S. PATENT DOCUMENTS

| | | | | |
|---|---|---|---|---|
| 1,618,867 | A * | 2/1927 | Ellis | 510/211 |
| 1,762,930 | A * | 6/1930 | Manson | 162/172 |
| 1,863,867 | A * | 6/1932 | Maze | 162/172 |
| 1,998,758 | A * | 4/1935 | Holt et al. | 162/10 |
| 2,127,668 | A * | 8/1938 | Adams et al. | 208/21 |
| 2,142,666 | A * | 1/1939 | Bucy | 101/416.1 |
| 2,227,516 | A * | 1/1941 | Soanes | 524/396 |
| 2,233,965 | A * | 3/1941 | Strovink | 137/7 |
| 2,536,018 | A * | 1/1951 | Schoenholz et al. | 428/203 |
| 3,529,516 | A * | 9/1970 | Pullen et al. | 493/59 |
| 5,106,415 | A * | 4/1992 | Davidian | 106/14.26 |
| 5,286,559 | A * | 2/1994 | Kaneko et al. | 428/32.68 |
| 6,406,786 | B1 * | 6/2002 | Stofko | 428/327 |
| 6,908,677 | B2 * | 6/2005 | Shoshany et al. | 428/403 |

OTHER PUBLICATIONS

Wax Types & Their Properties, Michelman, Inc. [on-line] 2003 [retrieved Apr. 5, 2006] Retrieved from the Internet: <URL:http://www.performanceadditives.com/waxtypes.htm>.*

US Environmental Protection Agency, "Potassium Silicate; Exemption from the Requirement of a Tolerance" <http://www.epa.gov/fedrgstr/EPA-PEST/2006/June/Day-14/p8939.htm>, supplied by applicant.*

FR Doc. E6-8939 Filed Jun. 13, 2006, [Federal Register: Jun. 14, 2006 (vol. 71, No. 114)] [Rules and Regulations] [p. 34267-34272], Environmental Protection Agency 40 CFR Part 180, [EPA-HQ-OPP-2006-0299; FRL-8069-6], supplied by applicant.*

* cited by examiner

*Primary Examiner*—Steven P. Griffin
*Assistant Examiner*—Dennis R. Cordray
(74) *Attorney, Agent, or Firm*—Dekel Patent Ltd.; David Klein

(57) ABSTRACT

A method including improving a property of a paper product precursor by adding a molten wax suspension to paper product precursor, the molten wax suspension including a suspension of liquid wax particles in a liquid solvent, the liquid wax particles being at a temperature higher than the melting point of the wax. The molten wax suspension may be added to the paper product precursor in a production line prior to making a finished paper product. A finished paper product may be made from the paper product precursor.

11 Claims, 1 Drawing Sheet

PAPER PRODUCT AND METHOD THEREFOR USING MOLTEN WAX SUSPENSION

CROSS REFERENCE TO OTHER APPLICATIONS

This application is a continuation-in-part of U.S. patent application Ser. No. 10/453,591, filed Jun. 4, 2003 now abandoned, the disclosure of which is incorporated herein, and claims priority therefrom.

FIELD OF THE INVENTION

The present invention relates generally to paper products, and particularly to imparting properties to paper products, such as with the addition of a molten-wax suspension into the production line of the paper product.

BACKGROUND OF THE INVENTION

Many different kinds of additives are used in the manufacture of paper products. For example, in techniques for coating paper, cardboard or the like, coating compositions may be used that contain one or several inorganic fillers, one or several binders and various additives. The goal of coating is to improve certain physical and optical characteristics of paper, such as but not limited to, gloss, brightness, opacity, capability for ink printing, smoothness and other properties of great commercial importance.

A composition for coating paper is generally formed from a filler which may comprise one or several pigments, one or several polymer binders and various additives such as, especially, a lubricant such as calcium stearate, a wax emulsion, or a fatty acid ester, and possibly antifoaming agents, and the like, as is known in the art.

In another example, the paper manufacturing industry generally uses cellulose, mechanical wood pulp, or fillers, such as kaolin or chalk and rosin sizes, as the principal components for paper and carton stock. Papers often need "sizing", i.e. hydrophobing. This is necessary in order to give writing paper proper ink resistance, to avoid "feathering". Similarly, printing stock should give a clear print with the best possible reproduction of contrast and with the minimum demand for printing ink. Also, for semi-manufactured products, such as base-paper for coating purposes, a limited degree of sizing is required to limit the degree of penetration of size-press preparatory solutions or surface coatings; full sizing is not desirable in this case because, apart from economic considerations, it would lead to a repulsion or separation of the surface treating material. There is therefore a distinction between full and partial sizing, e.g. half, quarter or one-eighth sizing.

The strength properties of paper and paper products include, but are not limited to, burst, tear, tensile, fiber bonding, crush strength, chemical resistance (e.g., to water, salt, oil) and the like. For example, in the paper-making process, cellulosic fibers may be softened with water before being processed into paper. Fillers such as clay, titanium dioxide, talc, and calcium carbonate, are added to the papermaking process to improve paper properties such as opacity, brightness, and printability. Each filler is unique due to differences in physical-chemical and morphological properties. One example of a substance which will reduce linting or dusting is clay. Titanium dioxide is an excellent filler for opacity purposes due to is high refractive index and small particle size. Due to its hydrophobicity, talc is an excellent pitch/stickiness control. In addition, talc is an excellent filler for purposes of improving machine drainage, sheet smoothness and printability.

U.S. Pat. No. 1,792,382 to Lodge et al. teaches that "waxes and fats generally, and paraffin specifically, materially improve the water resistance of paper and paper products when incorporated into the sheet of paper either by the process commonly known as engine sizing in which process a solution, emulsion or finely divided dispersed suspension of wax or waxes alone or in combination with rosin and/or other ingredients, is added to the paper pulp in the beaters". The wax suspension in Lodge et al. is a suspension of solid wax particles in a solvent.

European Patent EP0026091 describes a hydrophobic filler for papermaking, particularly in the production of partly to fully sized paper or carton stock. The hydrophobic filler is used in conjunction with a wax-based emulsion.

U.S. Pat. No. 6,565,646 to Lasmarias et al. describes a talc additive for use as a filler in making paper products which is useful in preventing dusting or Tinting of paper. The talc is milled to have a particle size of less than 10 micrometers and a cationic charge to the surface of the talc particles. For example, a cationic charge can be added to the particle by mixing talc particles with water to create a slurry and, adding a cationic compound to the slurry. In preferred embodiments, the cationic compound is selected from cationic wet-end starch, cationic wax-based emulsion, polydadmacs and carboxymethylcellulose.

SUMMARY OF THE INVENTION

The present invention seeks to provide an improved paper product and process therefor, by adding a molten wax suspension into the paper product at some point of the manufacturing process.

It is important to define clearly the difference between wax solution, wax emulsion, solid-wax suspension and liquid-wax suspension:

A wax solution is a homogenous liquid of miscible materials in which wax is dissolved in a main solvent, i.e., the wax is in its molecular or ion form. There is no way immiscible materials will form a solution (wax and water, for example, can never form a solution since wax cannot dissolve in water).

A "wax blend" is a solution of two or more waxes dissolved one in the other. The present invention covers using one wax as well as wax blends and mixtures.

A wax emulsion is a stable dispersion of immiscible materials. Wax emulsions of above-micron-size particles require emulsifiers to maintain stability. The emulsifiers prevent the wax particles from adhering to or merging with themselves.

A wax suspension is a buoyant dispersion of immiscible materials. Suspensions do not contain emulsifiers, and require agitation to maintain homogenous particles dispersion. In other words, the stability of a wax suspension depends on and is achieved by agitation of the particles, whereas the stability of a wax emulsion is attained by the use of an emulsifier.

A solid wax suspension is a buoyant dispersion of solid wax particles in a solvent. A liquid wax suspension is a suspension of liquid wax particles in a liquid solvent.

A molten wax suspension is a liquid wax suspension, wherein the liquid particles are maintained at temperatures higher than the melting point of the wax. A molten wax suspension is different from a solid suspension or emulsion. Maintaining a liquid-liquid suspension in general, and a molten-wax suspension in particular, necessitates special mixing considerations, such as to counter the tendency for liquid droplets to merge together or to avoid phase inversion. (Phase inversion is a known phenomenon where two immiscible liquids invert under agitation from one dispersed in the other to the other dispersed in the first. For example, wax in water emulsions are broadly used in the paper industry. Water in wax emulsions are broadly used in the cosmetics industry.)

Each of the above is a different form having different qualities and behavior. Employing a liquid or molten wax suspension in place of a wax solution, wax emulsion or solid wax suspension is not obvious. Unlike a wax emulsion, a liquid or molten wax suspension is substantially free of emulsifiers and therefore cannot be stored. (Molten wax suspensions with minute amounts of emulsifiers are also in the scope of the present invention. "Minute amounts" are amounts of emulsifiers that may be present in the molten suspension but which do not cause emulsification.) Wax suspensions must be prepared and maintained properly and intensively agitated adjacent to the paper production line. Lacking an "emulsifier coating", suspended liquid wax droplets will rapidly separate from the water and merge to a continuous wax phase without sufficient agitation. On the other hand, excess shear may cause "phase inversion".

The following explanation may help in understanding behavior of wax suspensions, but it is noted that the invention is not limited or dependent upon the correctness or incorrectness of the explanation. Unlike a wax emulsion, the inherent substantial lack of emulsifiers in the molten-wax suspension creates wax droplets that are significantly more "sticky" than emulsifier coated wax emulsion particles. Once introduced to the paper fibers medium, suspension droplets will instantaneously adhere to any other solid in the paper fiber medium, while emulsion particles stay emulsified until locked in place by the paper fibers. Accordingly, although the molten wax droplets of the suspension may contain the same wax as a wax emulsion, nevertheless the molten wax suspension has different properties than the wax emulsion. This difference might alter the rheological behavior of the paper fibers as well.

Adding a molten-wax suspension instead of an emulsion to the paper product may provide several advantages. Emulsions have to be stored at the site where the paper product is produced, and have a limited shelf life. The manufacture of emulsions uses a lot of energy and is relatively costly. In contrast, the raw materials for making the suspension are much cheaper and are much more stable. The molten wax suspension may be manufactured at the site where the paper product is produced. The excess heat of the paper production process may be used as part of the manufacturing process of the suspension. The heat source may be the excess heat of the production line in general, or the excess steam of the drying process in particular. Making the suspension at the site where the paper product is produced, and introducing the suspension on-line to the paper product, may provide significant savings in energy, storage, manpower, etc.

Due to its online production, the suspension is not sensitive to storage and/or storage conditions, such as but not limited to, excessive mechanical shear, pumping, excessively low or high ambient temperature, storage agitation, crust formation, particles agglomeration, and the like.

The molten-wax suspension may be used to impart a wide variety of characteristics to the paper product, such as but not limited to, sizing, hydrophobicity, water repellency, water absorption control, scuff resistance, lubricity, anti-blocking capability, release capability, friction control, shear stability, softening, rub resistance, preventing dusting or linting, glossiness, brightness, opacity, capability for ink printing, smoothness, dimensional stability, thickness control, density control, mechanical strength control, and paper preservation. "Preservation" encompasses any treatment with a preservative which reduces the rate of deterioration of the paper, compared to the rate of deterioration of an analogous paper lacking the preservative.

In one embodiment of the present invention, the paper product is made by adding a molten-wax suspension to the paper product. The term "adding" encompasses mixing, coating, dissolving, pouring, or any other action to make the suspension part of the finished paper product.

The suspension may be added to any paper or engineered paper product. The term "paper" encompasses, but is not limited to, paper, virgin pulp paper, recycled paper, recycled facing paper, paperboard, cardboard, corrugated sheet, carton, tissue paper, tracing paper and the like.

The suspension may be added to the paper in a variety of manners. For example, the suspension may be added to a slurry comprising the paper product, or may be added to a liquid feed stream that is fed to the paper product slurry. The suspension may be added as a wetting agent during the production or as a final stage of production of the paper product. As another example, the suspension may be added as a surface treatment to make the finished paper product.

The suspension may be applied as a single additive, in combination with other additives, or as a carrier for other additives.

There is thus provided in accordance with an embodiment of the present invention a method comprising adding a molten-wax suspension to a paper product precursor. The suspension may be added to the paper product precursor in a production line prior to making a finished paper product. The suspension may be manufactured at a site where the paper product precursor is produced. A finished paper product may be made from the paper product precursor.

In accordance with an embodiment of the present invention excess heat of producing the paper product precursor is used as part of manufacturing the suspension.

Further in accordance with an embodiment of the present invention the method comprises storing the wax or wax blend in a first storage container, storing a liquid in a second storage container, and forming the suspension by dispersing wax or wax blend in the liquid in a mixing device at a temperature higher than the melt point of said wax/wax blend. The suspension may be added directly from the mixing device to the paper product precursor. Alternatively, the suspension may be fed from the mixing device to an auxiliary mixing device, and the suspension is added from the auxiliary mixing device to the paper product precursor.

In accordance with an embodiment of the present invention the method comprises producing and adding the suspension to the paper product precursor in a production line, wherein the production line consumption is used to control the rate of suspension production.

Further in accordance with an embodiment of the present invention the molten-wax suspension enhances at least one of the following properties: sizing, hydrophobicity, water repellency, water absorption control, scuff resistance, lubricity, anti-blocking capability, release capability, friction control, shear stability, softening, rub resistance, preventing dusting or linting, glossiness, brightness, opacity, capability for ink printing, smoothness, dimensional stability, thickness control, density control, mechanical strength control, and paper preservation.

There is also provided in accordance with an embodiment of the present invention an article comprising a finished paper product made by adding a molten-wax suspension to a paper product precursor.

BRIEF DESCRIPTION OF THE DRAWINGS

The present invention will be understood and appreciated more fully from the following detailed description taken in conjunction with the drawing in which.

DETAILED DESCRIPTION OF EMBODIMENTS

Figure 1:
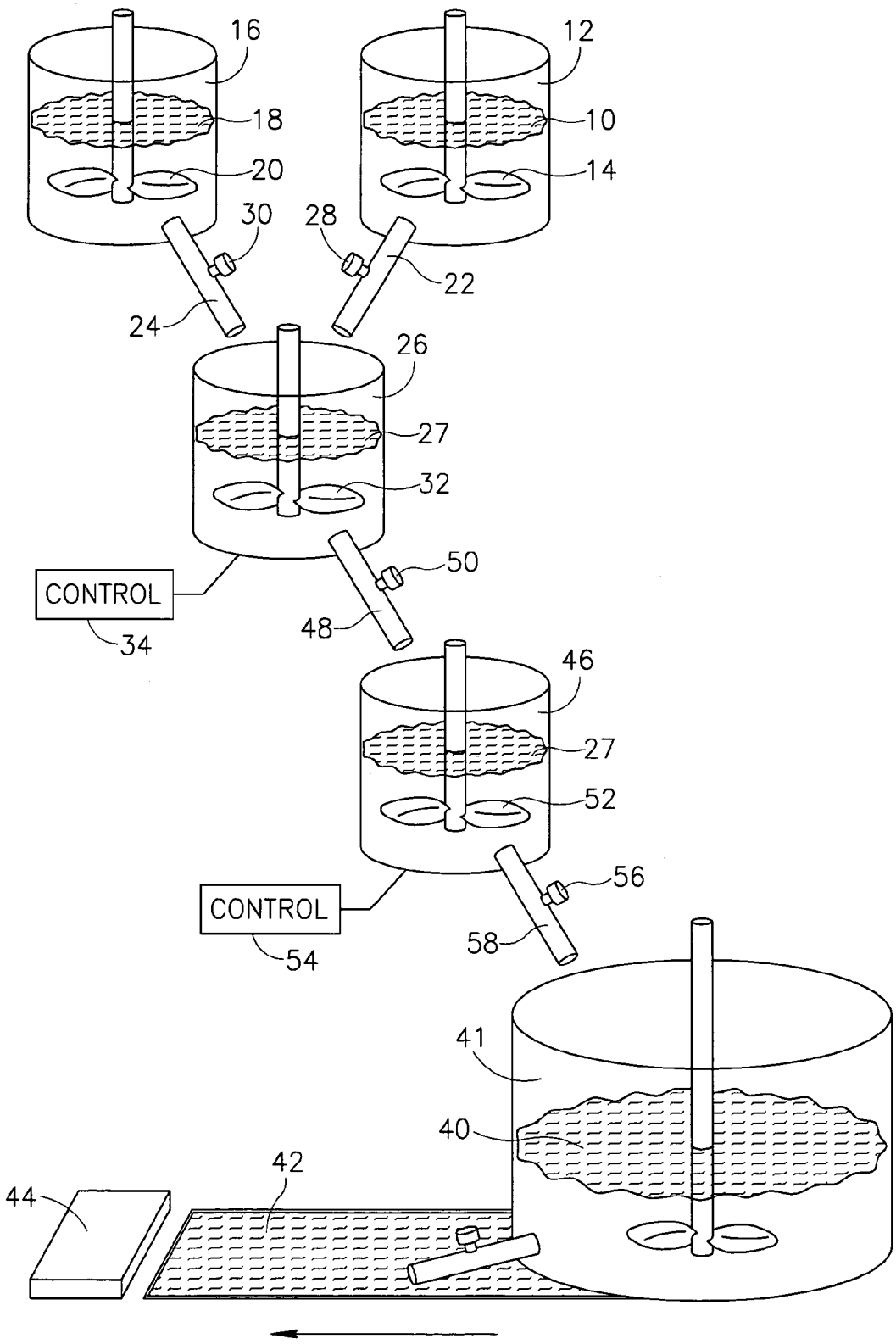
FIG. 1 is a simplified block diagram of a method and system for making a paper product, in accordance with an embodiment of the present invention.

Reference is now made to FIG. 1, which illustrates a method and system for making a paper product, in accordance with an embodiment of the present invention.

A wax or wax-blend 10 may be stored in a storage container 12. In accordance with one embodiment of the present invention, wax 10 may comprise, but is not limited to, organic wax (soft paraffin wax, macro-crystalline paraffin wax, micro-crystalline paraffin wax, montan wax etc), plant wax (candelilla wax, carnauba wax, soy wax, etc), animal wax (beeswax etc), synthetic wax (polyethylene wax, polypropylene wax, etc) maleated hydrocarbons and others, or any mixture (blend) thereof.

Wax 10 may be in the form of liquid, particles, flakes, pellets and other shapes, of any size. Storage container 12 may comprise a mixer 14. Dispersing aids (not shown) may be added to wax 10 in storage container 12. Mixer 14 may be used to reduce wax 10 to particles of any desired size. Provision may be made for controlling the temperature of the contents of storage container 12, such as, but not limited to, to a temperature higher than the melting point of the wax or wax blend. In a molten liquid state, mixer 14 may be used to blend a minimum of two waxes to form a wax-blend. Though not mandatory, it is preferable for wax 10 in container 12 to be in liquid molten state.

Another storage container 16 may be provided for storing therein a liquid 18, such as but not limited to, water, which will be used to disperse therein wax 10 to form a suspension. Storage container 16 may also comprise a mixer 20. Dispersing aids (not shown) may be added to liquid 18 in container 16. Provision may be made for controlling the temperature of the contents of storage container 16, such as, but not limited to, to a temperature higher than the melting point of the wax or wax blend. Furthermore, in the case of a solid wax in container 12, the temperature of liquid 18 may be controlled such that the latent heat of liquid 18 is enough to heat and melt wax 10 resulting in a liquid-liquid phase in container 26 below.

The contents, or any portion thereof, of storage containers 12 and 16 may be fed via tubing 22 and 24, respectively, to a batch mixing device 26, where wax 10 is dispersed in liquid 18 to form a molten-wax suspension 27. Controls 28 and 30, respectively, may control the flow of material from storage containers 12 and 16 to batch mixing device 26. Batch mixing device 26 may comprise a mixer 32, which may be any suitable dispersing mixer, such as but not limited to, a propeller, a stirrer, ultra-torrex, colloid-mill, or dissolver moving at any suitable rate to form or maintain suspension 27. A control unit 34 may be provided that controls operation of batch mixing device 26, such as but not limited to, the weight or volume of the substances being mixed, droplet size, the pressure or temperature of batch mixing device 26, and the time duration of mixing. Dispersing aids (not shown) may be added to the suspension in storage container 26.

Suspension 27 may be added directly, if desired, from batch mixing device 26 to a paper product precursor 42 on a production line for making a final paper product 44. The paper product precursor 42 may comprise, without limitation, a slurry, cellulose fiber mass, pulp mass, and the like. The term "paper product precursor" encompasses any form of the paper product ready for adding thereto molten-wax suspension 27 prior to the final manufactured form of the paper product 44. The final paper product 44 may include, without limitation, smooth sheets, cardboard, corrugated sheets, or other any other product form.

Suspension 27 may alternatively flow from batch mixing device 26 to a mixer 41, where suspension 27 is further mixed with other additives to make a fiber-suspension 40. Mixer 41 may comprise any suitable dispersing mixer, such as but not limited to, a beater, propeller, stirrer, or dissolver moving at any suitable rate to form or maintain fiber-suspension 40. A control process feeder 50, such as but not limited to, valve, pump, etc. may control the flow of suspension 27 to mixer 41.

As another alternative, suspension 27 may first flow from batch mixing device 26 to an auxiliary mixing device 46 via tubing 48. A control batch feeder valve 50 may control the flow of material from batch mixing device 26 to auxiliary mixing device 46. Auxiliary mixing device 46 may also comprise a mixer 52, which may be any suitable dispersing mixer, such as but not limited to, a propeller, stirrer, or dissolver moving at any suitable rate to form or maintain suspension 27. A control unit 54 may be provided that controls operation of auxiliary mixing device 46, such as but not limited to, the weight or volume of the substances being mixed, the pressure or temperature of auxiliary mixing device 46, and the time duration of mixing. A control process feeder 56, such as but not limited to valve, pump, etc. may control the flow of suspension 27, via tubing 58, to mixer 41. The production line and control process feeders 50 and 56 may operate in a closed control loop, wherein the consumption rate of the paper precursor production line automatically controls the production and feeding of suspension 27 to mixer 41.

In general, the molten-wax suspension comprising wax 10 may be added by itself to the paper product precursor 42, or other substances may be added to the suspension before its addition into the paper product precursor 42, or suspension 27 may be added to other components before adding to the paper product precursor 42.

It is noted that any of the mixing devices (e.g., "batch" or "auxiliary") may comprise provision for mixing discrete batches or continuous mixing of substances. It is further noted that the devices and equipment used in the above-described process are exemplary only, and the present invention is not limited to these devices or equipment.

The addition of molten suspension 27 or 40 may enhance properties of the final paper product 44. Examples of properties that may be enhanced by wax 10 in molten suspension 27 or 40 include, but are not limited to, sizing, hydrophobicity, water repellency, water absorption control, scuff resistance, lubricity, anti-blocking capability, release capability, friction control, shear stability, softening, rub resistance, preventing dusting or linting, glossiness, brightness, opacity, capability for ink printing, smoothness, dimensional stability, thickness control, density control, mechanical strength control, and paper preservation and any combination thereof.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A method comprising:

improving a property of a paper product precursor by adding and mixing a molten wax suspension into a slurry comprising said paper product precursor, said molten wax suspension comprising a suspension of liquid wax particles lacking an emulsifier coating in a liquid solvent, the liquid wax particles being at a temperature higher than the melting point of said wax, wherein said molten wax suspension is added to said slurry in a production line prior to making a finished paper product.

2. The method according to claim 1, wherein said molten wax suspension is manufactured at a site where the paper product precursor is produced.

3. The method according to claim 1, wherein said wax comprises at least one of organic wax, plant wax, animal wax, and synthetic wax.

4. The method according to claim 1, wherein said wax comprises a blend of at least two waxes.

5. The method according to claim 1, wherein excess heat of producing said paper product precursor is used as part of manufacturing said suspension.

6. The method according to claim 1, further comprising storing said wax in a first storage container, storing a liquid in a second storage container, and forming said molten wax suspension by dispersing said wax in said liquid in a mixing device at a temperature higher than the melting point of said wax.

7. The method according to claim 6, wherein said molten wax suspension is added directly from said mixing device to said slurry.

8. The method according to claim 6, wherein said molten wax suspension is fed from said mixing device to an auxiliary mixing device, and said molten wax suspension is added from said auxiliary mixing device to said slurry.

9. The method according to claim 6, further comprising controlling flow of said molten wax suspension to said slurry.

10. The method according to claim 1, further comprising forming a finished paper product from said paper product precursor.

11. The method according to claim 1, wherein said molten-wax suspension enhances at least one of the following properties: sizing, hydrophobicity, water repellency, water absorption control, scuff resistance, lubricity, anti-blocking capability, release capability, friction control, shear stability, softening, rub resistance, preventing dusting or linting, glossiness, brightness, opacity, capability for ink printing, smoothness, dimensional stability, thickness control, density control, mechanical strength control, and paper preservation.

* * * * *